US008979253B2

(12) United States Patent
Yamada et al.

(10) Patent No.: US 8,979,253 B2
(45) **Date of Patent: *Mar. 17, 2015**

(54) FLUID STORAGE CONTAINER

(71) Applicant: Seiko Epson Corporation, Tokyo (JP)

(72) Inventors: Manabu Yamada, Matsumoto (JP); Takeshi Komaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,749

(22) Filed: Nov. 18, 2013

(65) Prior Publication Data

US 2014/0071212 A1 Mar. 13, 2014

Related U.S. Application Data

(63) Continuation of application No. 13/595,671, filed on Aug. 27, 2012, now Pat. No. 8,613,504, which is a continuation of application No. 12/617,006, filed on Nov. 12, 2009, now Pat. No. 8,251,500.

(30) Foreign Application Priority Data

Nov. 14, 2008 (JP) ..... 2008-292644
Oct. 5, 2009 (JP) ..... 2009-231217

(51) Int. Cl.
*B41J 2/175* (2006.01)
*B41J 2/185* (2006.01)
*B41J 29/02* (2006.01)

(52) U.S. Cl.
CPC ..... *B41J 2/17533* (2013.01); *B41J 2/185* (2013.01); *B41J 29/02* (2013.01)
USPC ..... 347/86; 347/85

(58) Field of Classification Search
CPC . B41J 2/17503; B41J 1/17533; B41J 2/17513
USPC ..... 347/85–87
See application file for complete search history.

(56) References Cited

U.S. PATENT DOCUMENTS 5,329,306 A 7/1994 Carlotta
6,281,911 B1 8/2001 Nakazawa et al.

(Continued)

FOREIGN PATENT DOCUMENTS

EP 1 016 533 A1 7/2000
EP 1 162 072 A1 12/2001

(Continued)

OTHER PUBLICATIONS

**European Search Report issued Feb. 25, 2010 for Application No. 09175681 (6 Pages).

*Primary Examiner* — Anh T. N. Vo
(74) *Attorney, Agent, or Firm* — Nutter McClennen & Fish LLP; John J. Penny, Jr.; Rory P. Pheiffer

(57) ABSTRACT

A fluid storage container enables the easy removal of recovered fluid and reuse of the container without incurring the added costs of disassembly and replacing an absorbent material. In one exemplary embodiment, an ink cartridge 17 can have an ink storage unit 45 that stores waste ink, an ink inlet/outlet 55 disposed in a frame part 52 that can be the outside wall of the ink storage unit 45, an ink path 53 of which one end 53*a* communicates with the ink inlet/outlet 55 and the other end 53*b* is disposed opening into the ink storage unit, wall parts 54 that divide the ink storage unit 45 into an upper air chamber 61 and a lower fluid chamber 62 that communicate with each other through a communication path 58, and an outside air channel 87, of which one end 87*a* communicates with the air chamber 61 and the other end 87*b* enables communication with the outside at a position further from the air chamber 61 than the fluid chamber 62. Other embodiments of fluid storage containers are also disclosed.

7 Claims, 13 Drawing Sheets

(56) References Cited

U.S. PATENT DOCUMENTS

| | | | | |
|---|---|---|---|---|
| 6,550,885 | B2 | 4/2003 | Matsumoto et al. | |
| 6,966,640 | B2 | 11/2005 | Lee | |
| 6,966,940 | B2 | 11/2005 | Krisko et al. | |
| 7,018,029 | B2 | 3/2006 | Ishizawa et al. | |
| 7,090,341 | B1 | 8/2006 | Miyazawa | |
| 7,328,986 | B2 | 2/2008 | Wang | |
| 7,997,703 | B2 | 8/2011 | Naka et al. | |
| 8,025,376 | B2 | 9/2011 | Hattori et al. | |
| 8,066,361 | B2 * | 11/2011 | Miyajima et al. | 347/86 |
| 8,251,500 | B2 | 8/2012 | Yamada et al. | |
| 8,613,504 | B2 * | 12/2013 | Yamada et al. | 347/86 |
| 2003/0067521 | A1 | 4/2003 | Kaga et al. | |
| 2003/0103119 | A1 | 6/2003 | Sakai et al. | |
| 2005/0041061 | A1 | 2/2005 | Ishizawa et al. | |
| 2005/0212850 | A1 | 9/2005 | Kimura | |
| 2010/0123756 | A1 | 5/2010 | Yamada et al. | |
| 2011/0122208 | A1 | 5/2011 | Myers | |
| 2013/0027482 | A1 | 1/2013 | Yamada et al. | |

FOREIGN PATENT DOCUMENTS

| | | | |
|---|---|---|---|
| JP | 59-204569 | A | 11/1984 |
| JP | 08-132641 | A | 5/1996 |
| JP | 11-070672 | A | 3/1999 |
| JP | 2001-001541 | A | 1/2001 |
| JP | 2004-195653 | A | 7/2004 |
| JP | 2006-035588 | A | 2/2006 |
| JP | 2008-012823 | A | 1/2008 |
| JP | 2008-132641 | A | 6/2008 |
| JP | 2008-292644 | A | 12/2008 |
| JP | 2009-000893 | A | 1/2009 |
| JP | 2009-231217 | A | 10/2009 |
| WO | 2008/056736 | A1 | 5/2008 |

* cited by examiner

FLUID STORAGE CONTAINER

PRIORITY

The present application is a continuation of and claims priority under 35 U.S.C. §120 to U.S. patent application Ser. No. 13/595,671 filed on Aug. 27, 2012, entitled "Fluid Storage Container," which itself is a continuation of and claims priority under 35 U.S.C. §120 to U.S. patent application Ser. No. 12/617,006 filed on Nov. 12, 2009, entitled "Fluid Storage Container," and which issued as U.S. Pat. No. 8,251,500, the disclosures of each which, including the specification, drawings, and claims, are hereby incorporated by reference in their entireties. The present application also claims priority under 35 U.S.C. §119 to Japanese Patent Application No. 2008-292644, which was filed on Nov. 14, 2008, and Japanese Patent Application No. 2009-231217, which was filed on Oct. 5, 2009, the disclosures of which, including the specifications, drawings, and claims, are hereby incorporated by reference in their entireties.

BACKGROUND OF THE INVENTION

1. Technical Field

The present invention relates to a fluid storage container from which the stored fluid can be removed.

2. Description of Related Art

A printing device that prints using liquid ink is one example of a device that handles a fluid. An example of such a printing device is an inkjet printer that prints by supplying ink from a removable ink cartridge to a recording head, and then discharging ink droplets onto paper by means of the recording head.

One type of ink cartridge that may be used in such printing devices has a discharge ink recovery cartridge that holds an ink absorbing body such as a sponge and recovers discharged ink through an ink recovery path into the discharge ink recovery cartridge. See, for example, Japanese Unexamined Patent Appl. Pub. JP-A-S59-204569. A printer that enables replacing a waste ink absorber that absorbs waste ink is taught by Japanese Unexamined Patent Appl. Pub. JP-A-H11-70672. When all of the printing ink has been used and the ink cartridge is empty, the ink absorbing member still contains the absorbed ink, and thus, the ink absorbing member is dirty. Accordingly, even if the ink cartridge is refilled with ink, the recovered waste fluid (waste ink) is still in the cartridge and the ink cartridge cannot be used.

Therefore, once an ink cartridge has been used, it must either be thrown away or recycled by disassembling the ink cartridge, replacing the ink absorbing member with a new one, and refilling the cartridge with ink. This makes recycling more expensive than when the cartridge is simply reused, and further, has an undesirable impact on the environment.

SUMMARY OF THE INVENTION

A fluid storage container according to at least one embodiment of the present invention enables the easy removal of stored fluid and allows the container to be reused without incurring the added costs of disassembly and/or the replacement of an absorbent material.

To solve the foregoing problem, a fluid storage container according to a first aspect of at least one embodiment of the invention includes a fluid storage unit that can be configured to hold fluid; a fluid inlet/outlet opening for disposing fluid in the fluid storage unit and/or discharging fluid from the fluid storage unit and that can be located in a surrounding wall that forms the fluid storage unit; a fluid path having a first end that can communicate with the fluid inlet/outlet opening and a second end that can extend to and open into the fluid storage unit; a wall unit that can divide the fluid storage unit into a first chamber and a second chamber, whereby the first and second chambers can communicate with each other by way of a communication path; and an outside air channel having a first end that can communicate with the first chamber and a second end that can enable communication with an outside environment. The second end of the outside air channel can be at a position that is further from the first chamber than the second chamber.

A fluid storage container configured in such a manner can allow fluid to be easily introduced through the fluid path and stored in the fluid storage unit by injecting the fluid (waste fluid) through the fluid inlet/outlet opening. In order to remove the fluid inside the fluid storage unit, the fluid storage container can be placed in a manner such that the second end of the fluid path is down and the fluid can be removed by suction through the fluid inlet/outlet opening. As a result, the fluid in the fluid storage unit can be drawn from the second end of the fluid path, into the fluid path, and can be subsequently removed.

When fluid is introduced to the fluid storage unit, air in the fluid storage unit can be pushed by the fluid into the outside air channel and can be discharged to the outside. As a result, it can be difficult to increase the pressure inside the fluid storage unit. Thus, the fluid can be smoothly introduced into the fluid storage unit without the internal pressure causing the fluid to backflow.

Additionally, because the first end of the outside air channel can communicate with the first chamber and the second end of the outside air channel, which is the end open to the outside environment, can be disposed at a position that is further from the first chamber than the second chamber, the fluid in the fluid storage unit can be prevented from flowing to the outside environment through the outside air channel, regardless of the orientation of the fluid storage container. Accordingly, waste fluid can be stored without using an absorbing member to hold recovered fluid. Further, the stored waste fluid can be reliably removed and the fluid storage container can be easily reused without being disassembled.

In a fluid storage container according to another aspect of at least one embodiment of the invention, the first chamber can be divided into a plurality of mutually communicating buffer chambers and a space on a side of the communication path and the outside air channel can communicate through the buffer chambers. As a result, when fluid in the second chamber flows into the first chamber, the fluid can be prevented from flowing into the outside air channel by the buffer chambers, and the flow of fluid to the outside can be even more reliably prevented.

In a fluid storage container according to another aspect of at least one embodiment of the invention, air passage units in which the buffer chambers can communicate can be disposed in a zigzag pattern. As a result, the flow of fluid between buffer chambers can be effectively suppressed, the effectiveness of preventing fluid from flowing to the outside air channel can be improved, and the flow of fluid out of the fluid storage container can be more reliably prevented.

In a fluid storage container according to another aspect of at least one embodiment of the invention, the second chamber can be larger than the first chamber and the fluid path can slope gradually from the first end of the fluid path to the second end of the fluid path and into the second chamber. As a result, fluid delivered to the fluid inlet/outlet opening can flow smoothly down the slope, inside the fluid path, can be guided into the fluid storage unit, and can be collected in the second chamber. Thus, it can be easier to collect the introduced fluid only in the second chamber.

In a fluid storage container according to another aspect of at least one embodiment of the invention, the fluid path can be formed in the wall unit. The structure of a fluid storage container according to at least one embodiment of this aspect of the invention can be simplified by forming the fluid path in the wall unit dividing the fluid storage unit into a first chamber and second chamber.

In a fluid storage container according to another aspect of at least one embodiment of the invention, an elastic deformable member that is configured to increase a capacity of the second chamber by deforming elastically when the internal pressure of the second chamber rises can be disposed in the second chamber. If, for example, a fluid storage container according to this aspect of the invention is disposed with the first chamber position on the bottom when the first chamber is filled with fluid, the elastic deformable member can deform so that the volume of the second chamber increases if the internal pressure of the second chamber rises due to a temperature change or pressure change. As a result, an increase in the internal pressure of the fluid storage unit can be suppressed, and problems such as the rise in internal pressure pushing the fluid collected on the first chamber side into the outside air channel and to the outside can be prevented.

In a fluid storage container according to another aspect of at least one embodiment of the invention, formation parts configured to form the fluid path can be configured so that a second chamber side of the second end of the fluid path is shorter than a first chamber side of the first end of the fluid path. With a fluid storage container according to this aspect of the invention, negative pressure inside the second chamber can be easily buffered and removal of the fluid stored in the fluid storage container can be made easier because air in the first chamber can easily move into the negative pressure second chamber.

In a fluid storage container according to another aspect of at least one embodiment of the invention, a buffer chamber of the plurality of buffer chambers with which the communication path communicates can be rendered so that a cross sectional area connecting corners of walls of the first buffer chamber that form the communication path can be greater than or equal to 63 square millimeters. A fluid storage container according to this aspect of the invention can cause bubbles that move into the first chamber to pop, and can thereby prevent fluid contained in the bubbles from flowing into the first chamber.

In a fluid storage container according to another aspect of at least one embodiment of the invention, a first buffer chamber of the plurality of buffer chambers with which the communication path communicates can be rendered so that it is larger than the other buffer chambers. Rendering only the buffer chamber that extinguishes the bubbles large and the other buffer chambers small allows a plurality of buffer chambers to be rendered in a fluid storage container.

Yet further preferably, in a fluid storage container according to another aspect of at least one embodiment of the invention, the outside air channel can be formed substantially surrounding a first chamber and a second chamber, or can be disposed along a periphery of the fluid storage container. A long, outside air channel can thus be disposed, and leakage of fluid from the fluid storage container and through the outside air channel can be reduced.

In another exemplary embodiment of a fluid storage container, the container can include a housing having a first chamber and a second chamber formed therein, a communication path disposed between the first and second chambers configured for communication therebetween, a fluid path disposed between the first and second chamber and configured to receive fluid into the housing and remove fluid from the housing, and an exit path disposed between the first chamber and an outside environment. The first and second chambers and the communication, fluid, and exit paths can be configured such that when fluid is received into the housing, the fluid flows into the fluid path, into the communication path, and into the second chamber. Air located in the housing can be pushed by the fluid, into the first chamber, and out of the housing by way of the exit path.

In one embodiment, an internal pressure of the container does not rise, even when fluid flows into the fluid path. The fluid path can be formed on a top side of a vertical center of the housing. The fluid path can have a first end that extends through the housing and to the outside environment and a second end that extends into the housing and to at least one of the first chamber, the second chamber, and the communication path. The exit path, meanwhile, can have a first end configured to communicate with the first chamber and a second end configured to communicate with the outside environment. The second end of the exit path can be more proximal to the second chamber than to the first chamber. The ink path can be configured to slope gradually downward from its first end to its second end. In one embodiment, a valve can be located at the first end of the fluid path. The valve can be configured to control a flow of fluid between the fluid path and the outside environment.

The container can also include a plurality of buffer chambers formed in the first chamber. The buffer chambers can be configured to communicate between the communication path and the exit path. In one embodiment the plurality of buffers are at a position separated from the communication path. A first buffer chamber of the plurality of buffer chambers with which the communication path communicates can be rendered so that a cross sectional area connecting corners of walls of the first buffer chamber forming the communication path is greater than or equal to 63 square millimeters. Alternatively, or additionally, a first buffer chamber of the plurality of buffer chambers with which the communication path communicates can be larger than the other buffer chambers.

The plurality of buffers can include a plurality of dividers that can be formed substantially parallel with the communication path. A plurality of holes can be formed in the plurality of dividers to assist in communication between the communication path and the exit path. In one embodiment the plurality of holes can be formed in the plurality of dividers in a zigzag pattern. In another embodiment a plurality of air channels can be formed in the housing and can be configured to communicate with one or more buffer chambers.

The exit path can be formed near a periphery of the housing. In one embodiment, at least one fluid collection chamber can be formed in the exit path on a side of the housing that is opposite from a side in which fluid enters the fluid path from the outside environment. In another embodiment a first wall and a second wall, in which the first wall is more proximal to the second chamber than the first chamber, can form the fluid path. A length of the first wall can be shorter than a length of the second wall.

In one embodiment a plurality of ribs can be formed in the second chamber. The ribs can be substantially horizontal to the communication path, and each of the plurality of ribs can be approximately parallel to each other. In another embodiment the fluid storage container can include a film disposed in the housing. The film can be configured to form a wall of at least one of the first chamber, the second chamber, the communication path, and the fluid path. In still another embodiment, the fluid storage container can include an elastic deformable member. The elastic deformable member can be disposed in the second chamber, and further, can be configured to increase a capacity of the second chamber by deforming elastically when internal pressure within the second chamber rises.

Other objects and attainments, along with a fuller understanding of the invention, will become apparent and appreciated by referring to the following description and claims taken in conjunction with the accompanying drawings.

DESCRIPTION OF PREFERRED EMBODIMENTS

Certain exemplary embodiments of a fluid storage container according to the present invention will now be described to provide an overall understanding of the principles of the structure, function, manufacture, and use of the devices disclosed herein. One or more examples of these embodiments are illustrated in the accompanying drawings. Those skilled in the art will understand that the devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Figure 1:
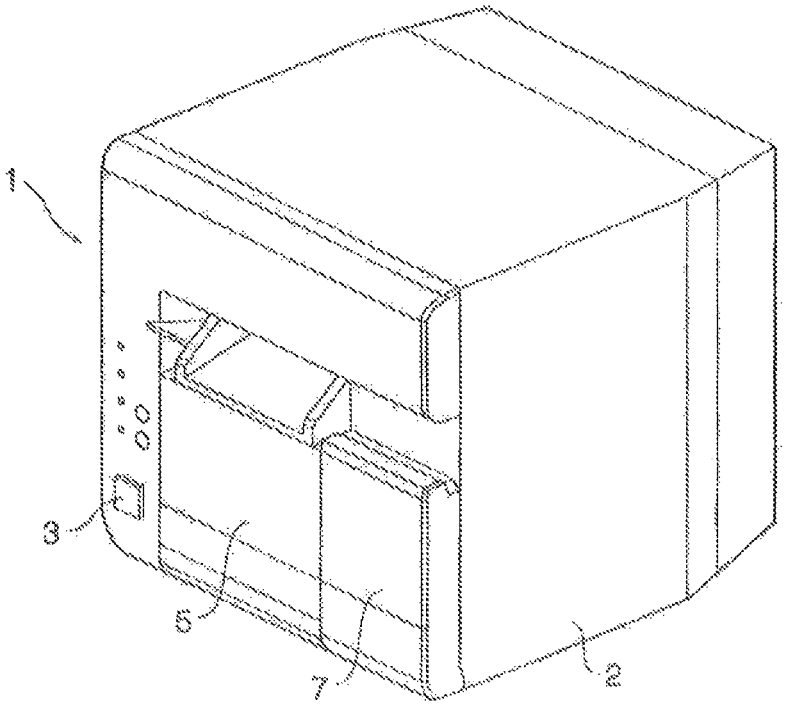
FIG. 1 is an oblique view of an inkjet printer in which an ink cartridge, which can be a fluid storage container according to at least one embodiment of the invention, is installed.
Figure 2:
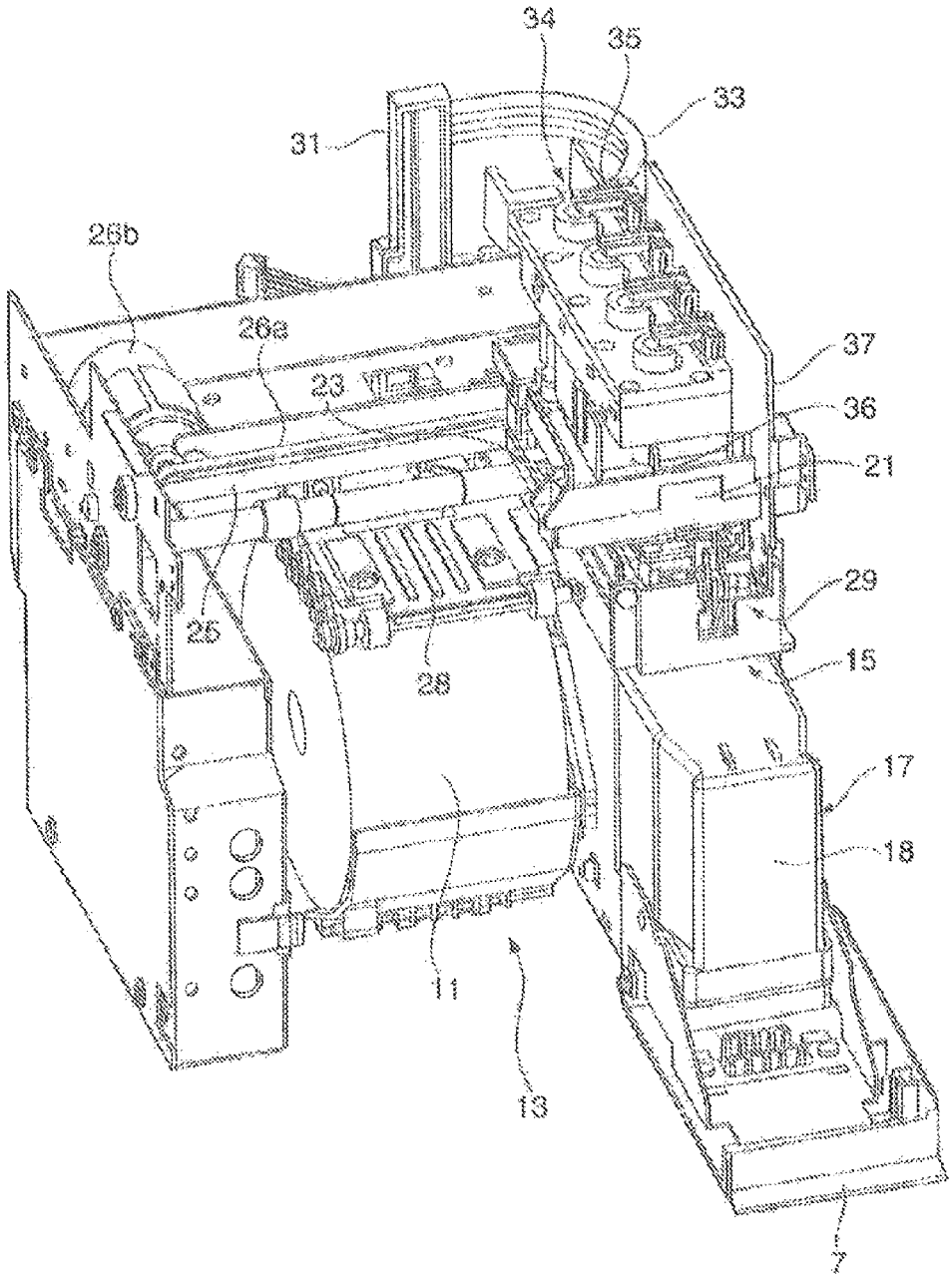
FIG. 2 is an oblique view of the inkjet printer of FIG. 1 with the printer case removed.
Figure 3B:
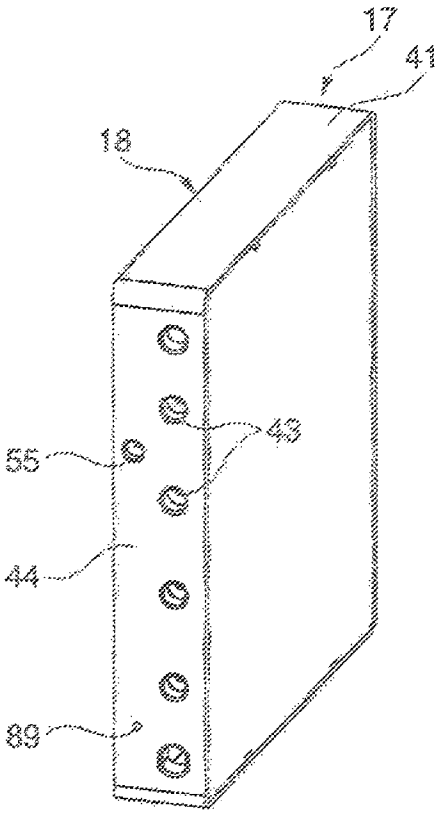
FIGS. 3A and 3B are oblique views of the ink cartridge of FIG. 2.
Figure 3A:
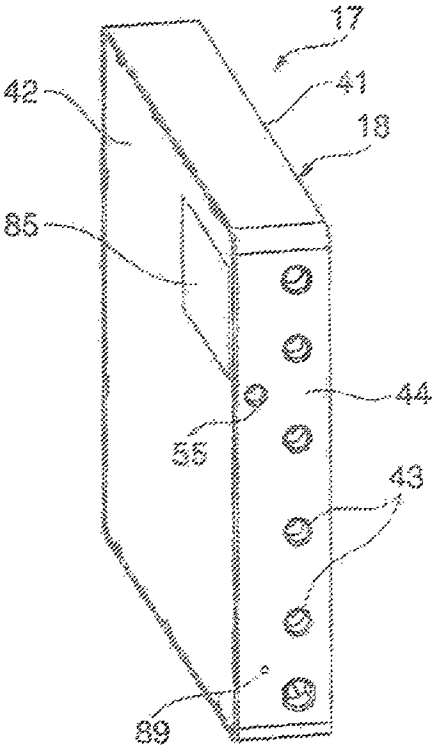
Figure 4:
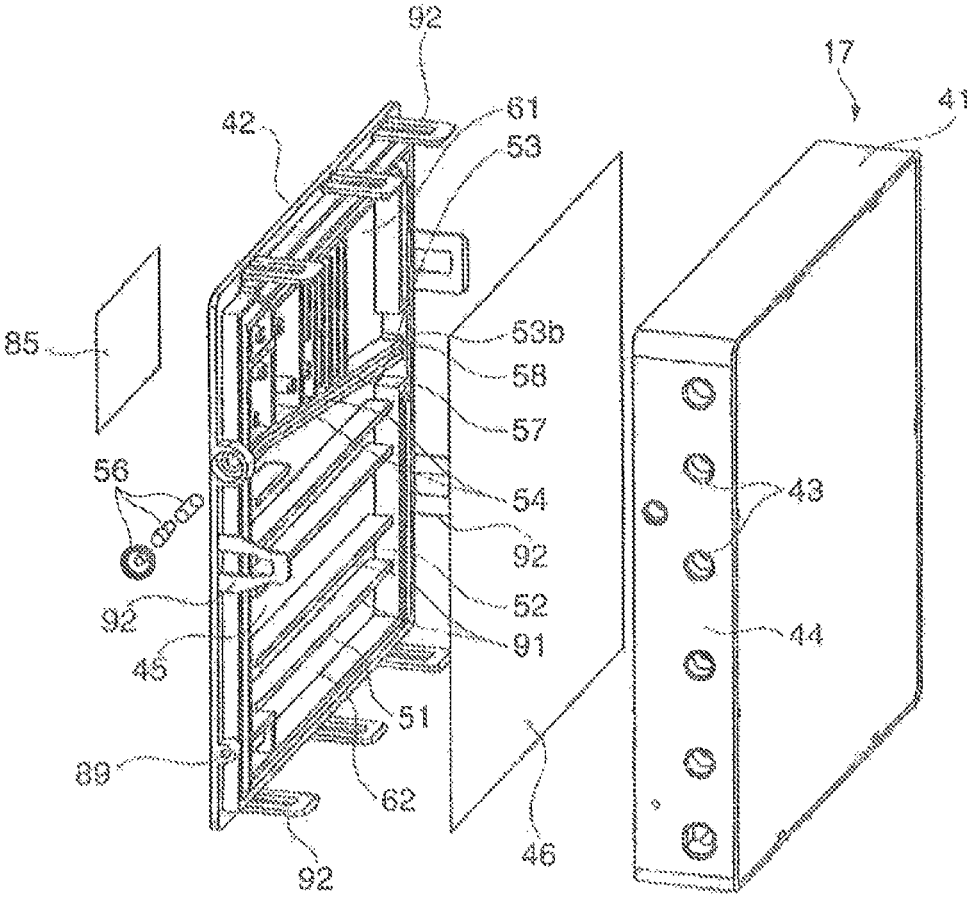
FIG. 4 is an exploded oblique view from the right side of the ink cartridge shown in FIG. 2.
Figure 5:
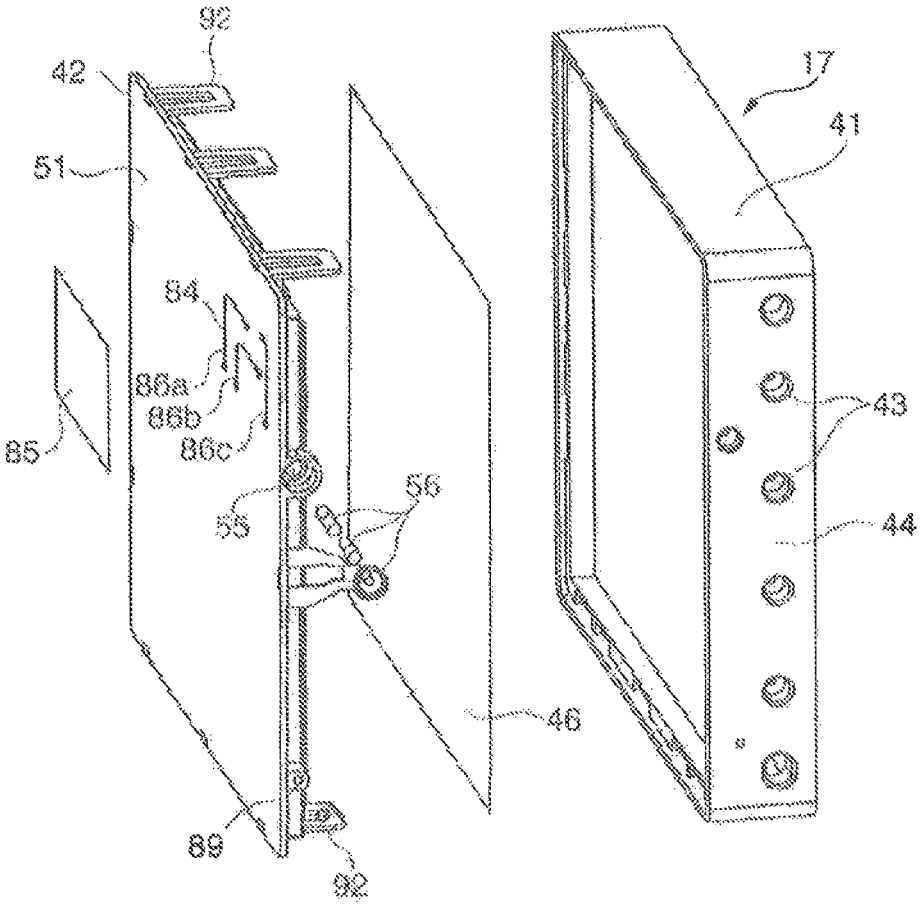
FIG. 5 is an exploded oblique view from the left side of the ink cartridge shown in FIG. 2.
Figure 6:
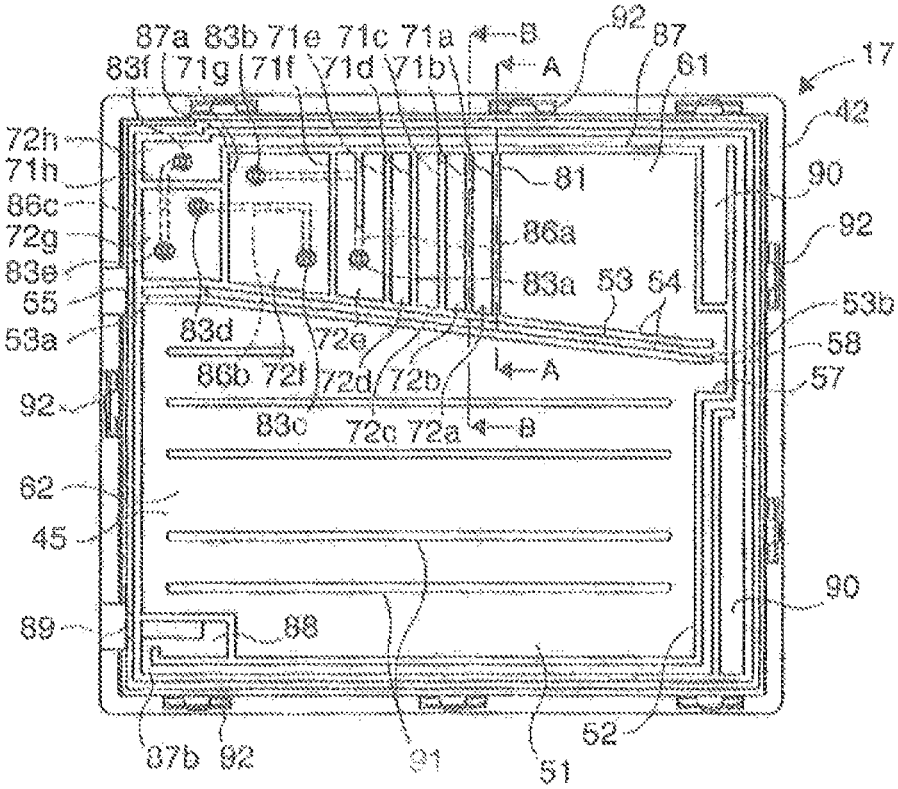
FIG. 6 is a section view showing the internal structure of the ink cartridge shown in FIG. 2.
Figure 7A:
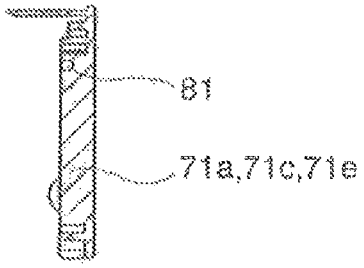
FIGS. 7A and 7B illustrate section views through lines A-A and B-B of FIG. 5.
Figure 7B:
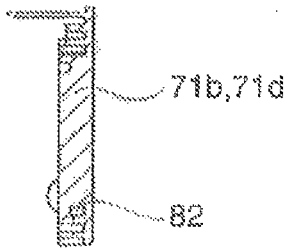
Figure 8:
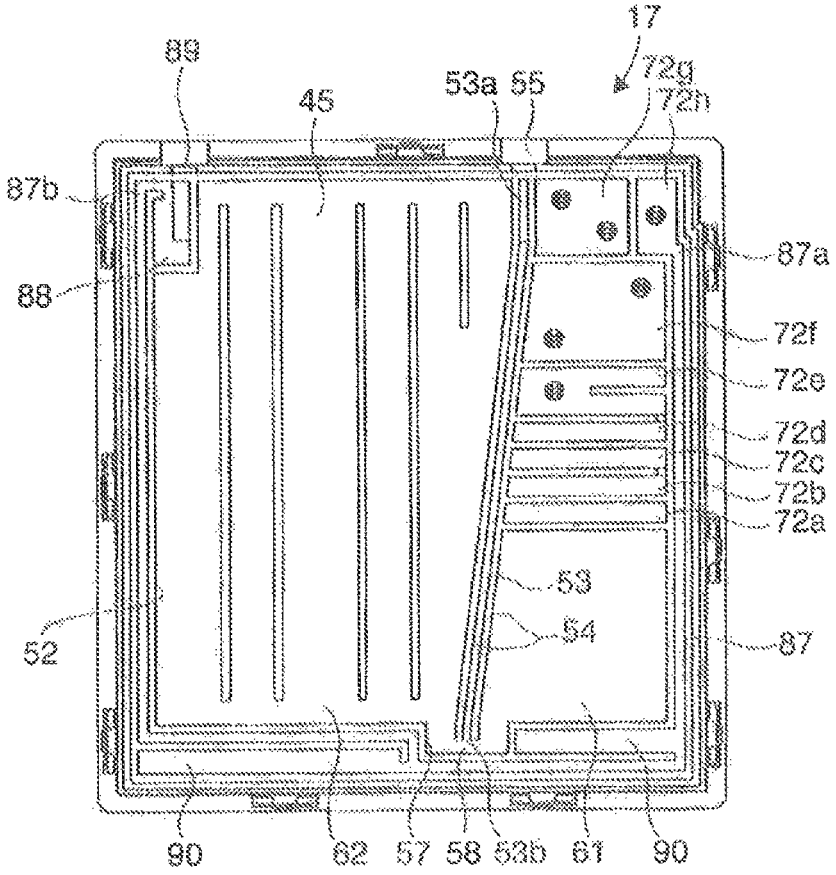
FIG. 8 is a section view of the ink cartridge when the ink cartridge is positioned for fluid removal.

FIG. 1 is an oblique view of an inkjet printer in which an ink cartridge, which can be a fluid storage container according to at least one embodiment of the invention, is installed, and FIG. 2 is an oblique view of the inkjet printer with the printer case removed. FIGS. 3A and 3B are oblique views of the ink cartridge, FIG. 4 is an exploded oblique view of the ink cartridge from the right side, and FIG. 5 is an exploded oblique view of the ink cartridge from the left side. FIG. 6 is a section view showing the internal structure of the ink cartridge. FIGS. 7A and 7B show section views through lines A-A and B-B of FIG. 5. FIG. 8 is a section view of the ink cartridge when positioned for a fluid removal operation.

The construction of an inkjet printer in which one embodiment of an ink cartridge is loaded is described below.

As shown in FIG. 1, the inkjet printer 1 can use a plurality of different colors of ink to print in color on a part of a paper delivered from a roll of paper. The inkjet printer 1 can have a roll paper cover 5 and an ink cartridge cover 7 that can be disposed to open and close freely at the front of the printer case 2 that covers the printer assembly. While a number of other features can also be included on the printer case, in the illustrated embodiment at least a power switch 3, paper feed switch, and indicators are disposed on the front of the printer case 2.

As shown in FIG. 2, opening the roll paper cover 5 can open the paper compartment 13 in which the roll paper (medium) 11 used as the print medium can be stored so that the roll paper 11 can be replaced. Further, opening the ink cartridge cover 7 can open the cartridge loading unit 15, enabling the installation and removal of the ink cartridge (fluid storage container) 17 from the cartridge loading unit 15. In this embodiment of the invention, opening the ink cartridge cover 7 can also cause the ink cartridge 17 to be pulled a specific distance forward in front of the cartridge loading unit 15.

A carriage 23, on which the inkjet head 21 can be mounted, can be disposed above the paper compartment 13, inside the printer case 2. The carriage 23 can be supported to move freely widthwise to the paper by means of a guide member 25 that can extend widthwise to the roll paper 11, and can be moved bi-directionally widthwise to the roll paper 11, above the platen 28, by means of an endless belt 26*a* and a carriage motor 26*b*. The endless belt 26*a* can be disposed widthwise to the roll paper 11, and the carriage motor 26*b* can drive the endless belt 26*a*. The inkjet head 21 can print by discharging ink to the part of the roll paper 11 delivered thereto.

As shown in FIG. 2, the standby position (home position) of the bi-directionally moving carriage 23 is opposite the cartridge loading unit 15 with the roll paper 11 therebetween. An ink vacuum mechanism 29 that vacuums ink from inside the ink nozzles of the inkjet head 21 exposed below the carriage 23 can be disposed below this standby position.

The ink cartridge 17 can store a plurality of color ink packs (not shown) inside the cartridge case 18. Each of the ink packs inside the ink cartridge 17 can be made of an elastic material and can be sealed with ink stored inside. When the ink cartridge 17 is loaded into the cartridge loading unit 15, an ink supply needle (not shown) can be disposed on the cartridge loading unit 15 side and can be inserted into and connect with one or more ink supply openings 43 of the ink packs, described in further detail below. The ink path 31 that can be fixed inside the printer case 2 can be connected to the ink supply needle of the cartridge loading unit 15 and one end of a flexible ink supply tube 33 can include a channel for each color, and further, can be connected to the ink path 31. The other end of the ink supply tube 33 can be connected to one or more ink pump units 34 that can be disposed in the carriage 23 for each of the one or more colors. Each ink pump unit 34 can be disposed above the inkjet head 21, and each ink pump unit 34 can be connected to the self-sealing unit 36, which can be connected to the inkjet head 21.

In addition to the inkjet head 21, the ink pump unit 34 and the self-sealing unit 36 can be disposed in unison with the carriage 23. As a result, ink from each ink pack inside the ink cartridge 17 can be supplied to the ink nozzles of the inkjet head 21 from the ink supply needle of the cartridge loading unit 15 and through each of the ink path 31, the ink supply tube 33, the ink pump unit 34 for each color, and the self-sealing unit 36 for each color.

The ink pump unit 34 can pull ink from the ink cartridge 17 as a result of carriage 23 movement, and a regulator panel 37 that can cause the ink pump unit 34 to operate by movement of the carriage 23 can be disposed in front of the direction of carriage 23 movement to the standby position. When the rocker arm 35 of the ink pump unit 34 contacts the regulator panel 37 as a result of the carriage 23 moving to the standby position, the rocker arm 35 can rock and drive the internal pump. As a result, ink can be drawn from the ink cartridge 17. Further, ink vacuumed from the inkjet head 21 by the ink vacuum mechanism 29 when cleaning the inkjet head 21 can be returned to the ink cartridge 17 as waste ink.

An ink cartridge 17 according to one embodiment of the invention that is installed in the cartridge loading unit 15 of the foregoing inkjet printer 1 is described next.

As shown in FIGS. 3A, 3B, 4, and 5, the ink cartridge 17 can have a carriage case 18 that is shaped like a box. The carriage case 18 can have a case body 41 and a cover 42. Ink packs can be disposed inside the case body 41, and the ink supply openings 43 of the ink packs can be arrayed on an installation face 44, which can be on one side of the case body 41.

An ink storage unit (fluid storage unit) 45 or housing that stores waste ink (waste fluid) can be formed on the cover 42 side of the ink cartridge 17. The ink storage unit 45 can be formed by the cover 42 and a film 46 affixed to the cover 42. The cover 42 can have a panel 51 formed to be substantially flat and a frame part (surrounding wall) 52 rising from around the edge of the flat panel 51. A high rigidity film 46 can be affixed so that it covers the frame part 52 and the ink storage unit 45, and thus, can be formed in the cover 42.

As shown in FIG. 6, an ink path (fluid path) 53 that extends side to side can be formed on a top side of a vertical center in the ink storage unit 45. The orientation of the ink cartridge 17 as shown in FIG. 6 is the orientation when the ink cartridge 17 is installed in the cartridge loading unit 15, and waste ink is guided into the ink storage unit 45 in this orientation. Other orientations of the ink cartridge 17 and the ink path 53, including but not limited to other orientations disclosed herein, can also be formed without departing from the spirit of the invention.

The ink path 53 can be formed by the flat panel 51, a pair of wall parts 54 that rise from the flat panel 51, and the film 46. One end 53*a* of the ink path 53 can be open at the installation face 44, and the other end 53*b* can be open near the frame part 52 on the opposite side of the installation face 44. The one end 53*a* of the ink path 53 that is opened at the installation face 44 can communicate with the ink inlet/outlet (fluid inlet/outlet) 55 formed in the installation face 44. A valve 56 that opens when the ink discharge needle (not shown in the figure) is inserted can be associated with the ink inlet/outlet 55, for example, by disposing the valve in the ink inlet/outlet 55. The valve 56 can control the flow of fluid between the ink path 53 and an outside environment. A recess 57 that is recessed toward the outside can be formed in the frame part 52 at a position near the other end 53*b* of the ink path 53, and the other end 53*b* of the ink path 53 can be open inside the recess 57.

The ink storage unit 45 in which the ink path 53 can be formed can be divided by the ink path 53 into an air chamber (first chamber) 61 in the top part and a fluid chamber (second chamber) 62 in the bottom part, and the gap between the ink path 53 and the bottom of the recess 57 can render a communication path 58 between the air chamber 61 and the fluid chamber 62. In the illustrated embodiment, the ink path 53 is formed in the top part of the ink storage unit 45, above the vertical center, and the fluid chamber 62 is larger than the air chamber 61.

The ink path 53 can also be formed sloping gradually downward from the one end 53*a* on the installation face 44 side to the other end 53*b* on the recess 57 side. The ink path 53 can thus slope down toward the fluid chamber 62 from the one end 53*a* to the other end 53*b*. Further, a plurality of buffer chambers 72*a* to 72*h* that can be separated from each other by a plurality of dividers 71*a* to 71*h* rising from the flat panel 51 can be formed in the air chamber 61 side in an area on the opposite side of a communication path 58.

As shown in FIG. 7A, dividers 71*a*, 71*c*, 71*e* can have a vent hole 81 rendered by a channel that can be formed on the film 46 side. Further, as shown in FIG. 7B, the film 46 and dividers 71*b*, 71*d* can have a vent hole 82 formed on the flat panel 51 side. Plural dividers 71*a* to 71*g* can be formed substantially parallel to the direction the waste ink flows from the fluid chamber 62 to the air chamber 61 at the communication path 58.

In the illustrated embodiment, the vent holes 81 are disposed in the top part of the air chamber 61, and the vent holes 82 are formed in the bottom part of the air chamber 61. As a result, the buffer chamber 72*a* communicates near the top with the space on the communication path 58 side, the buffer chamber 72*b* communicates with the buffer chamber 72*a* near the bottom, the buffer chamber 72*c* communicates with the buffer chamber 72*b* near the top, the buffer chamber 72*d* communicates with the buffer chamber 72*c* near the bottom, and the buffer chamber 72*e* communicates with the buffer chamber 72*d* near the top. The vent holes 81 and 82 can be formed at different positions in the thickness direction of the ink cartridge 17. Likewise, holes 83*a* to 83*f* can be formed at different positions. For example, in the illustrated embodiment, the hole 83*a* is formed in the flat panel 51 in buffer chamber 72*e*, the pair of holes 83*b* and 83*c* is formed in the flat panel 51 in the buffer chamber 72*f*, the pair of holes 83*d* and 83*e* is formed in the flat panel 51 in the buffer chamber 72*g*, and the hole 83*f* is formed in the flat panel 51 in the buffer chamber 72*h*.

As shown in FIG. 5, a plurality of channel parts 84 can be formed in the flat panel 51, on the opposite side of the ink storage unit 45. A high rigidity transparent film 85 can be applied to the flat panel 51 on the opposite side of the ink storage unit 45 so that the transparent film 85 can cover the channel parts 84. As a result, a plurality of air channels 86*a*, 86*b*, 86*c* that can be rendered by the channel parts 84 and transparent film 85 can be formed in the flat panel 51, on the opposite side of the ink storage unit 45. In one embodiment, the air channel 86*a* can communicate with the hole 83*a* in the buffer chamber 72*e* and the hole 83*b* in the buffer chamber 72*f*, the air channel 86*b* can communicate with the hole 83*c* in the buffer chamber 72*f* and the hole 83*d* in the buffer chamber 72*g*, and the air channel 86*c* can communicate with the hole 83*e* in the buffer chamber 72*g* and the hole 83*f* in the buffer chamber 72*h*.

An outside air channel (exit path) 87 can be formed near a periphery of the ink storage unit 45 such that it passes along the top side, the opposite side of the installation face 44, and the bottom side. One end 87*a* of the outside air channel 87 can communicate with the buffer chamber 72*h* in the air chamber 61, and the other end 87*b* can communicate with an air release chamber 88 that can be formed in the bottom of the installation face 44 side. An air escape hole 89 that can be connected to the air release chamber 88 can be formed in the installation face 44 at a position near the bottom, and thus, the outside air channel 87 can be open to outside air through the air escape hole 89. As a result, the outside air channel 87 that communicates with the air chamber 61 and the atmosphere can be rendered with the other end 87*b*, on the air escape side, at a position further from the air chamber 61 than the fluid chamber 62. A fluid collection chamber 90 that can be open at the top thereof can be formed in the outside air channel 87 on the opposite side of the installation face 44.

A plurality of ribs 91 can be formed rising from the flat panel 51 in the fluid chamber 62 of the ink storage unit 45. The ribs 91 can be disposed substantially horizontal and approximately mutually parallel in the direction impeding the flow of waste ink from the fluid chamber 62 to the air chamber 61, via the communication path 58, and can maintain space between the flat panel 51 and the film 46. Further, a plurality of engaging tabs 92 capable of engaging catch parts (not shown in the figure) that can be formed on the case body 41 side can be formed around the outside edge of the flat panel 51 of the cover 42. As a result, when the cover 42 is assembled to the case body 41, the engaging tabs 92 can engage the catches and the cover 42 can be attached to the case body 41.

When the ink cartridge 17 is installed to the cartridge loading unit 15 of the inkjet printer 1, the ink supply needles that can be disposed on the cartridge loading unit 15 side can be inserted into the ink supply openings 43 and ink of each color can be supplied to the inkjet printer 1 side. Additionally, when the ink cartridge 17 is installed in the cartridge loading unit 15, the ink discharge needle that can be disposed on the cartridge loading unit 15 side can be inserted to the ink inlet/outlet 55. As a result, waste ink discharged by cleaning the inkjet head 21 can be fed through the ink discharge needle and to the ink inlet/outlet 55. The waste ink fed to the ink inlet/outlet 55 can pass through the ink path 53, can be fed from the other end 53*b* of the ink path 53 into the ink storage unit 45, and can be collected in the fluid chamber 62.

Because in the illustrated embodiment the ink path 53 slopes down to the fluid chamber 62 side from the one end 53*a* on the ink inlet/outlet 55 side to the other end 53*b* that opens inside the recess 57, waste ink that is fed into the ink inlet/outlet 55 flows smoothly along the slope in the ink path 53, is guided into the ink storage unit 45, and is collected in the fluid chamber 62. When the waste ink is fed as described above, the air inside the ink storage unit 45 can be pushed by the inflowing waste ink from the communication path 58 side, through the sequentially communicating buffer chambers 72*a* to 72*h*, into the outside air channel 87 by means of the vent holes 81 and 82 and the air channels 86*a* to 86*c*, and is then guided by the outside air channel 87, into the air release chamber 88, and discharged to the outside by way of the air escape hole 89. The internal pressure of the ink storage unit 45, therefore, does not rise even when waste ink flows in. As a result, the waste ink that is fed through the ink discharge needle is guided smoothly into the ink storage unit 45 without back-flowing due to the internal pressure.

The used ink cartridge 17 can be removed from the cartridge loading unit 15 of the inkjet printer 1 after the ink in the ink packs is depleted. As a result, the ink supply needles that can be on the cartridge loading unit 15 side can be pulled out from the ink supply openings 43 of the ink packs and the ink discharge needle can be pulled out from the ink inlet/outlet 55. Waste ink can be stored in the fluid chamber 62 of the ink cartridge 17 at this time, and the amount of waste ink flowing into the air chamber 61 can be minimized, even if the ink cartridge 17 is turned in the direction enabling the waste ink to flow easily from the fluid chamber 62, through the communication path 58, and into the air chamber 61 (the bottom as seen in FIG. 6), at least because the ribs 91 can interfere with the flow of the waste ink. Because in the illustrated embodiment the plurality of dividers 71*a* to 71*h* in the air chamber 61 are disposed substantially parallel to the direction of waste ink flow from the fluid chamber 62 to the air chamber 61, by way of the communication path 58, waste ink that has flowed into the air chamber 61 does not move into the buffer chambers 72*a* to 72*h*.

Removing waste ink from the foregoing ink cartridge 17 so that the ink cartridge 17 can be reused is described next.

As shown in FIG. 8, when the ink cartridge 17 is removed from the cartridge loading unit 15, it can be positioned so that the other end 53*b* of the ink path 53 is on the bottom. As a result, the ink path 53 can be positioned vertically, and waste ink inside the ink storage unit 45 can collect on the other end 53*b* side of the ink path 53. An ink suction needle (not shown) can then be inserted into the ink inlet/outlet 55 of the ink cartridge 17 to vacuum ink from the ink cartridge 17. As a result, the waste ink inside the ink storage unit 45 of the ink cartridge 17 can be drawn from the other end 53*b* of the ink path 53, into the ink path 53, and can be removed through the ink suction needle. Negative pressure can therefore be produced inside the ink cartridge 17, but the negative pressure does not become high and does not interfere with ink suction because air flows in through the outside air channel 87, that is, in the opposite direction as when waste ink flows into the fluid chamber 62.

Furthermore, when the amount of waste ink left in the ink storage unit 45 is slight and the fluid surface of the waste ink is near the inside surface of the frame part 52 disposed at the bottom, even the small amount of waste ink left in the recess 57 can be reliably vacuumed out through the ink path 53 because the other end 53*b* of the ink path 53 can open inside the recess 57. After the waste ink is removed from the ink storage unit 45, the ink cartridge 17 can be reused by refilling the ink packs with ink.

Furthermore, whether the ink cartridge 17 described above is oriented as shown in FIG. 8 for removing waste ink from the ink storage unit 45, is inverted to this position, or is placed with the installation face 44 down, waste ink inside the ink storage unit 45 can be prevented from flowing to the outside, through the outside air channel 87, because the outside air channel 87 can be formed around the fluid chamber 62 and the other end 87*b* thereof. The other end 87*b*, as illustrated, is the end of the outside air channel 87, which is open to the outside, and is positioned further from the air chamber 61 than the fluid chamber 62.

Still further, because in the illustrated embodiment the buffer chambers 72*a* to 72*h* each communicate with adjacent chambers that are disposed in the air chamber 61 at a position separate from the communication path 58 connecting the air chamber 61 and fluid chamber 62, the flow of waste ink from the fluid chamber 62 into the outside air channel 87 is prevented.

Additionally, because in the illustrated embodiment the vent holes 81 and 82 formed in the divider 71*a* separating buffer chamber 72*a* and the space on the communication path 58 side of the air chamber 61, and the dividers 71*b* to 71*e* separating the buffer chambers 72*b* to 72*e* are disposed in a zigzag pattern in the vertical and thickness directions of the ink cartridge 17, the flow of waste ink through the buffer chambers 72*a* to 72*e* is effectively suppressed in all directions. Thus, the flow of waste ink in the fluid chamber 62, into the outside air channel 87, is effectively prevented, and the flow of waste ink to the outside is more effectively prevented. If waste ink enters the outside air channel 87, the waste ink can collect in the air release chamber 88 or the fluid collection chamber 90 that can be formed in the outside air channel 87. In such instances, the waste ink can be prevented from flowing out from the air escape hole 89.

By injecting ink from the ink inlet/outlet 55, the waste ink can be easily guided through the ink path 53, into the ink storage unit 45, and collected with the ink cartridge 17 described as a fluid storage container herein. Furthermore, because in the illustrated embodiment the air in the ink storage unit 45 is pushed by the in-flowing waste ink from the communication path 58 side, through the sequentially communicating buffer chambers 72*a* to 72*h* to the outside air channel 87, guided by the outside air channel 87 to the air release chamber 88, and externally discharged from the air escape hole 89 when waste ink is introduced to the ink storage unit 45, the internal pressure in the ink storage unit 45 does not rise even when waste ink flows in. As a result, waste ink can be smoothly guided into the ink storage unit 45 without the internal pressure causing the waste ink to backflow.

Additionally, the waste ink can also be vacuumed from the ink storage unit 45 through the ink inlet/outlet 55, for example, when the other end 53*b* of the ink path 53 is positioned on the bottom. The ink cartridge 17 can thus collect waste ink without using an absorbent material to retain the waste ink, and the accumulated waste ink can be removed and the ink cartridge 17 can be easily reused without being disassembled.

Still further, because in the illustrated embodiment the other end 87*b* of the outside air channel 87, that is, the end open to the outside, is disposed to a position that is further from the air chamber 61 than the fluid chamber 62, waste ink in the ink storage unit 45 can be reliably prevented from flowing out through the outside air channel 87, regardless of how the ink cartridge 17 is oriented after the ink cartridge 17 is removed from the cartridge loading unit 15. Yet further, in embodiments in which the buffer chambers 72*a* to 72*h* that can communicate with the adjacent chambers are disposed in the air chamber 61 at a position separated from the communication path 58 connecting the air chamber 61 and fluid chamber 62, waste ink in the fluid chamber 62 can be prevented from flowing to the outside air channel 87, and the flow of waste ink to the outside can be even more reliably prevented.

Furthermore, in embodiments in which the vent holes 81 and 82 are formed in the divider 71*a* separating buffer chamber 72*a* and the space on the communication path 58 side of the air chamber 61 and the dividers 71*b* to 71*e* separating the buffer chambers 72*b* to 72*e* are disposed in a zigzag pattern in the vertical and thickness directions of the ink cartridge 17, the flow of waste ink through the buffer chambers 72*a* to 72*e* can be effectively suppressed, the flow of waste ink from the fluid chamber 62 to the outside air channel 87 can be more effectively prevented, and the flow of waste ink to the outside can be more reliably prevented.

Still further, because in the illustrated embodiment the ink path 53 slopes down the fluid chamber 62 side from the one end 53*a* on the ink inlet/outlet 55 side to the other end 53*b* open inside the recess 57, the waste ink that is fed to the ink inlet/outlet 55 flows smoothly inside the ink path 53, down the slope, into the ink storage unit 45, and can be collected in the fluid chamber 62, which is larger than the air chamber 61. Yet further, in embodiments in which the air channels 86*a* to 86*c* connecting the buffer chambers 72*e* to 72*h* can be seen through the transparent film 85, the outflow of waste ink from the air chamber 61 can be easily checked. If waste ink is found to be sticking in the air channels 86*a* to 86*c*, the waste ink can be expected to have flowed to the outside air channel 87, and the ink cartridge 17 can be disassembled, cleaned, and recycled instead of being reused.

Another embodiment of an ink cartridge according to the present invention is described next.

Figure 9:
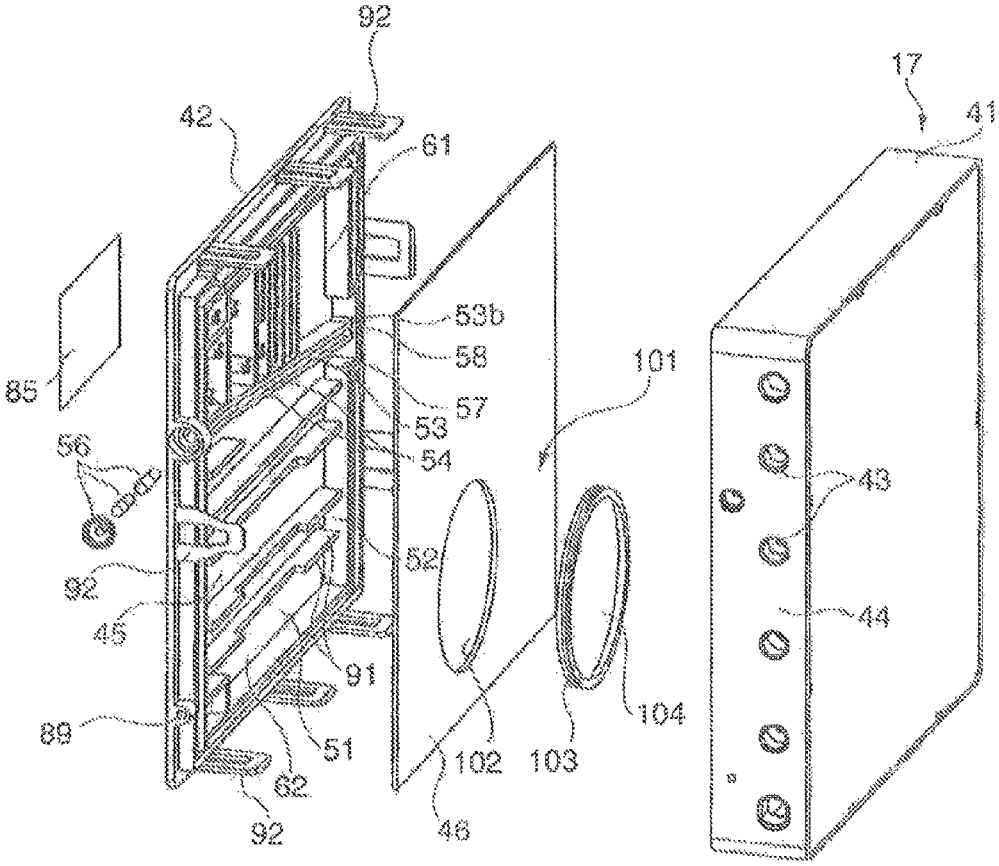
FIG. 9 is an exploded view of another embodiment of an ink cartridge according to the invention.
Figure 10:
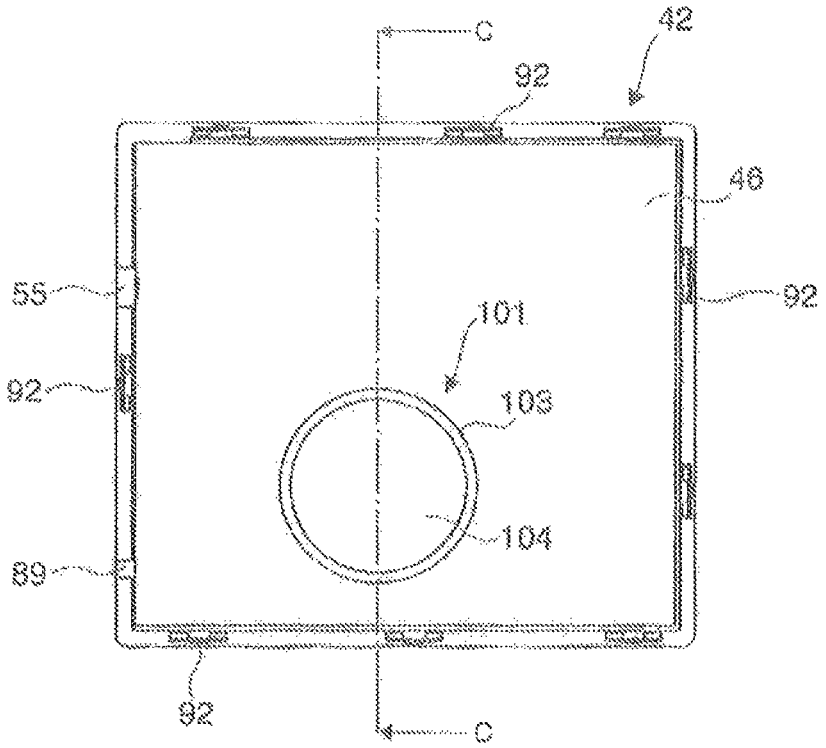
FIG. 10 is a plan view of the cover of the ink cartridge shown in FIG. 9 when seen from the film side.
Figure 11:
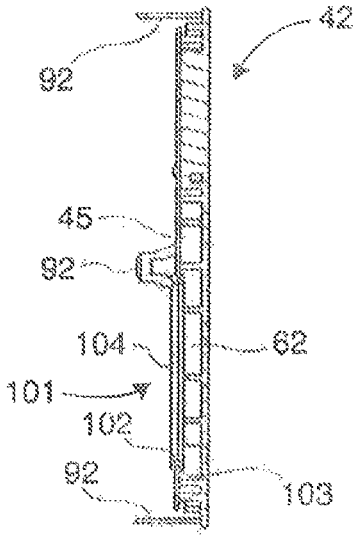
FIG. 11 is a section view through line C-C of FIG. 10.

FIG. 9 is an exploded view of an ink cartridge according to another embodiment of the invention and FIG. 10 is a plan view of a cover with an ink storage unit when seen from the film side. FIG. 11 is a section view through line C-C of FIG. 10, FIG. 12 is a section view of the ink cartridge showing the orientation of the ink cartridge, and FIG. 13 is a vertical section view of the ink cartridge when oriented as shown in FIG. 12.

As shown in FIG. 9 to FIG. 11, a damper (elastic deformable member) 101 can be disposed in or on the film 46 of the ink cartridge 17B. Because in the illustrated embodiment the damper 101 is disposed on the fluid chamber 62 side, the damper 101 is configured with an elastic damper film 104 having an annular seal 103 affixed to a mounting hole 102 formed in the high rigidity film 46. The damper film 104 can be, for example, a laminated elastic film having a rubber sheet disposed between a polyethylene terephthalate (PET) film and a polypropylene (PP) film.

Figure 12:
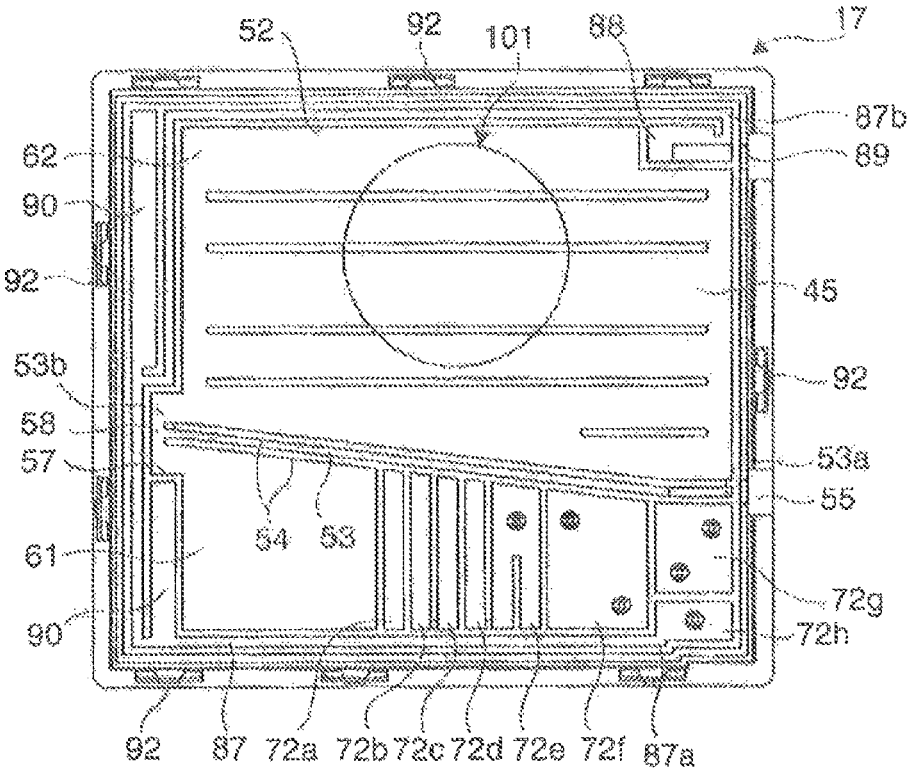
FIG. 12 is a section view of the ink cartridge showing the orientation of the ink cartridge of FIG. 9.
Figure 13:
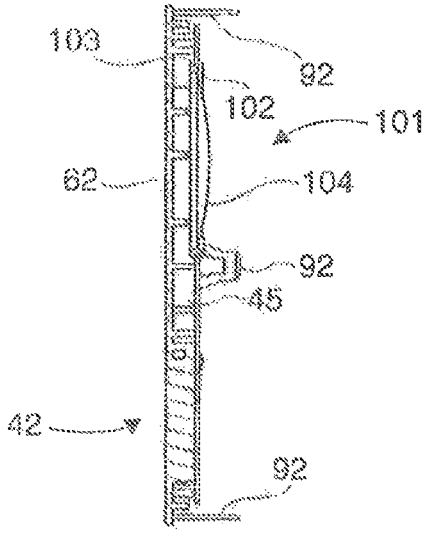
FIG. 13 is a vertical section view of the ink cartridge of FIG. 9 when the ink cartridge is oriented as shown in FIG. 12.

As shown in FIG. 12, with the ink cartridge 17B having the damper 101, the air chamber 61 can be disposed at the bottom. When the internal pressure of the ink storage unit 45 rises due to a temperature change or pressure change, the damper film 104 of the damper 101 can expand by deforming to the outside, as shown in FIG. 13, and the rise in internal pressure can be absorbed by the increased volume of the ink storage unit 45. An increase in the internal pressure of the ink storage unit 45 can, therefore, be suppressed, and waste ink accumulated in the air chamber 61 can be prevented from being forced into the outside air channel 87 by the increase in internal pressure.

An ink cartridge according to another embodiment of the invention is described next.

Figure 14:
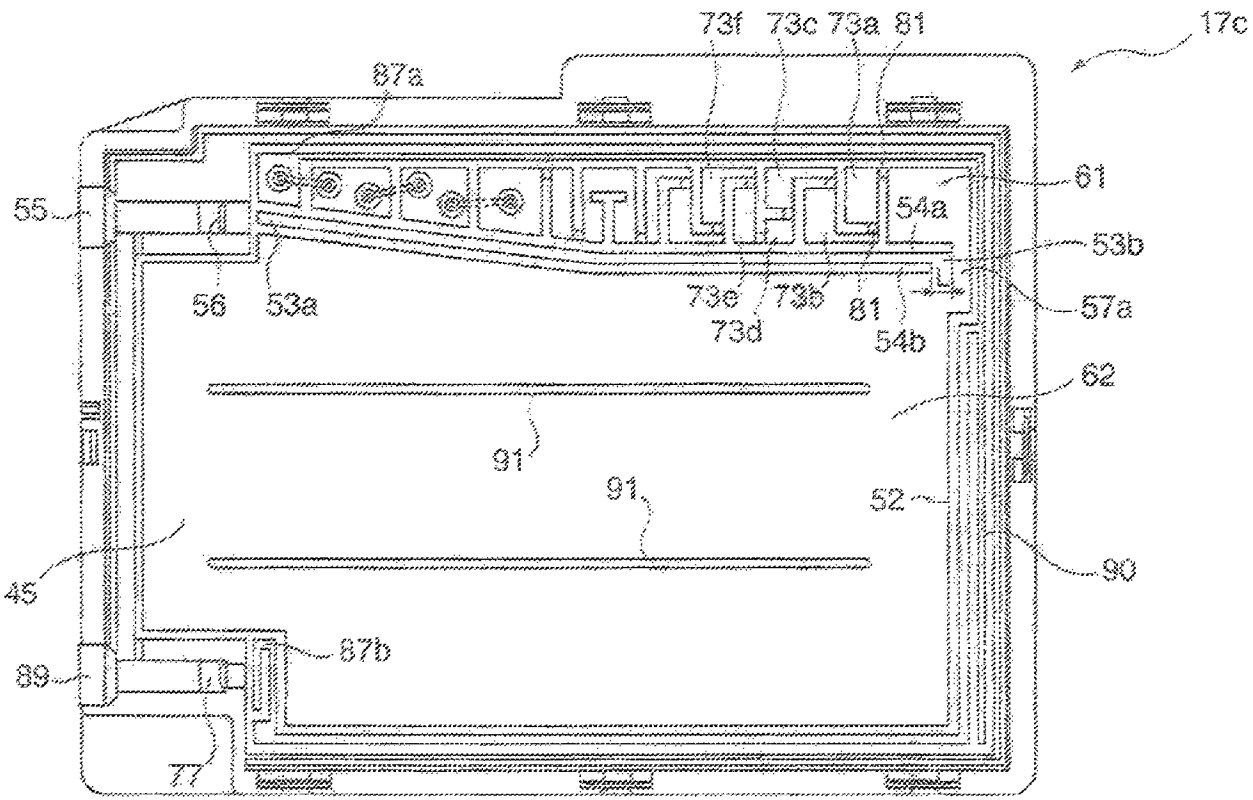
FIG. 14 is a section view of yet another embodiment of an ink cartridge that illustrates an internal structure of the ink cartridge.
Figure 15:
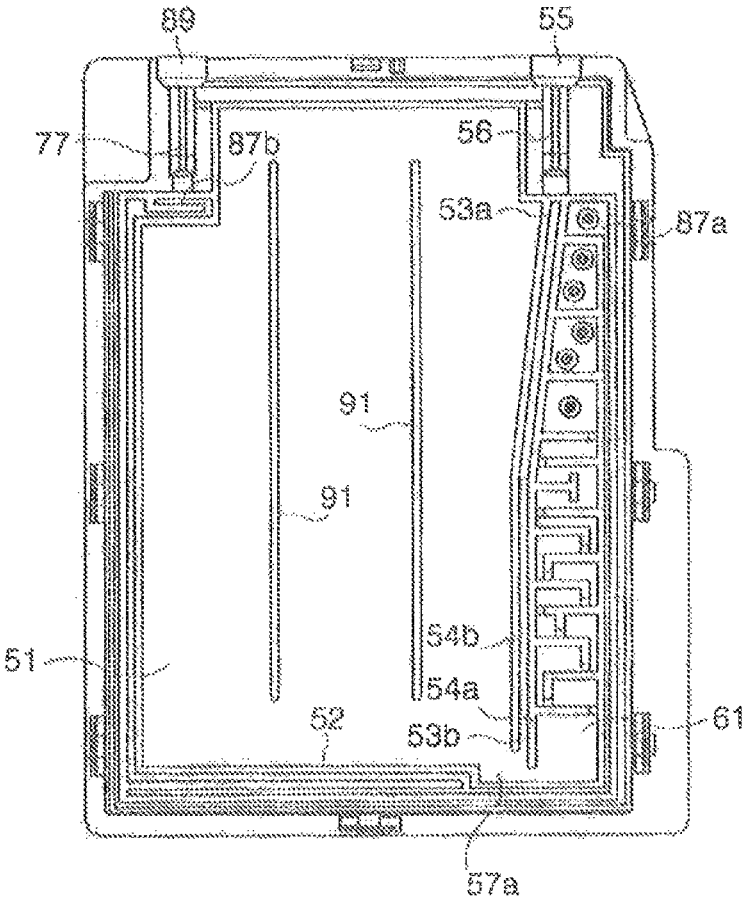
FIG. 15 is a section view of the ink cartridge shown in FIG. 14, illustrating an alternative orientation during fluid removal.

For brevity, parts with the same or similar function to parts in the foregoing embodiments are identified using the same reference numerals. This is the case for all embodiments disclosed herein, unless indicated to the contrary. FIG. 14 is equivalent to FIG. 6 of one of the earlier embodiments, and is a section view showing the internal structure of the ink cartridge 17C. FIG. 15 is equivalent to FIG. 8 of one of the earlier embodiments, and is a section view showing the orientation and condition of the ink cartridge 17C when removing the fluid.

One difference between the presently discussed embodiment and previous embodiments is that the area ratio of the fluid chamber 62 (second chamber) is increased and the area ratio of the air chamber 61 (first chamber) is decreased. As a result, the recess 57*a* wherein the other end 53*b* of the ink path 53 can be positioned can be formed at a top corner position of the frame part 52, as shown in FIG. 14. Additionally, the pair of walls 54*a* and 54*b* that rise from the flat panel 51 and form the ink path 53 can be rendered at the other end 53*b* of the ink path 53 so that the end of the wall 54*a* on the air chamber 61 side is inside the recess 57*a* and the end of the wall 54*b* on the fluid chamber 62 side is short of the end of wall 54*a* by length L and is positioned above the recessed part of the recess 57*a*.

How the waste ink is removed from the ink cartridge 17C so that the ink cartridge 17C can be reused is described next.

As shown in FIG. 15, when the ink cartridge 17C is removed from the cartridge loading unit 15 and is positioned with the other end 53*b* of the ink path 53 down, the ink path 53 can be vertically oriented and the waste ink in the ink storage unit 45 can collect at the other end 53*b* side of the ink path 53. A valve 77 can be associated with the air escape hole 89 of the ink cartridge 17C so that the waste ink cannot leak from the air escape hole 89 when the ink cartridge 17C is alone. The valve 77 in this embodiment of the invention can be configured identically to the valve 56 associated with the ink inlet/outlet 55, but other valve configurations may be used instead.

By appropriately opening the valve 77 when the ink cartridge 17C is loaded in the cartridge loading unit 15 and when removing waste ink, waste ink can be easily introduced to the ink storage unit 45 and waste ink can be easily removed from the ink storage unit 45. After opening the valve 77, an ink suction needle (not shown) can be inserted into the ink inlet/outlet 55 of the ink cartridge 17C, as in the earlier embodiments, to remove the waste ink. As a result, waste ink in the ink storage unit 45 of the ink cartridge 17C can be pulled from the other end 53*b* of the ink path 53, into the ink path 53, and removed through the ink suction needle. While negative pressure can be produced inside the ink cartridge 17 at this time, the negative pressure does not become high due to air inflow from the air chamber 61, and therefore does not interfere with ink suction.

Figure 16:
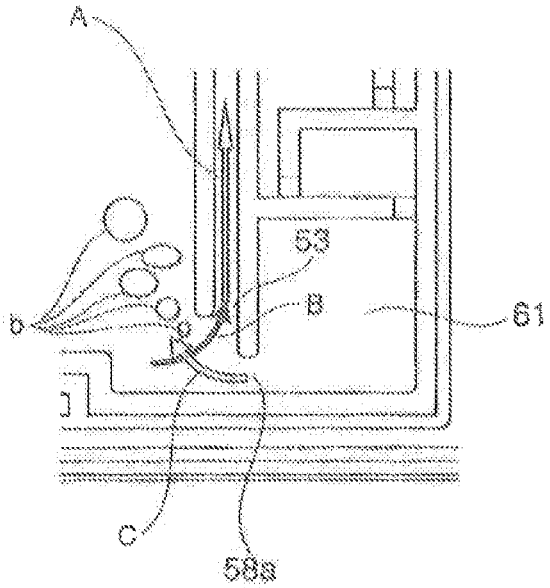
FIG. 16 is a schematic diagram illustrating air flow movement from the air chamber to the storage chamber of the ink cartridge of FIG. 14.

One difference between this embodiment and the earlier embodiments is that the end of the wall 54*b* on the fluid chamber 62 side is shorter than the end of the other wall 54*a* by length L. Described more specifically with reference to the air flow diagram in FIG. 16, which schematically illustrates movement of air from the air chamber to the storage chamber, waste ink from the fluid chamber 62 side can move in the direction of arrow B and can be recovered when the waste ink is vacuumed in the direction of arrow B from the ink path 53. Air in the air chamber 61 can pass through communication path 58*a*, to the negative pressure fluid chamber 62, and can move as bubbles b in the direction of arrow C. In the illustrated embodiment, the number of bubbles b that pass from the air chamber 61, through the communication path 58*a*, and to the ink path 53 side is reduced by the shoulder produced by length difference L. The waste ink in the fluid chamber 62 can thus be replaced with air, and vacuum efficiency can be greatly increased. The end of the wall part 54*b* on the fluid chamber 62 side can be disposed at a position elevated from the recessed part of the recess 57*a* in this embodiment, but the end of the wall 54*b* may be positioned inside the recessed part of the recess 57*a*. More particularly, as shown, the part of the ink path 53 on the fluid chamber 62 side must be shorter than the part on the air chamber 61 side.

The extinction of bubbles in the air chamber 61, which is disposed on the communication path 58*a* side in each of the embodiments described above, when waste ink is fed into the ink storage unit is described next with reference to FIG. 17.

Figure 17:
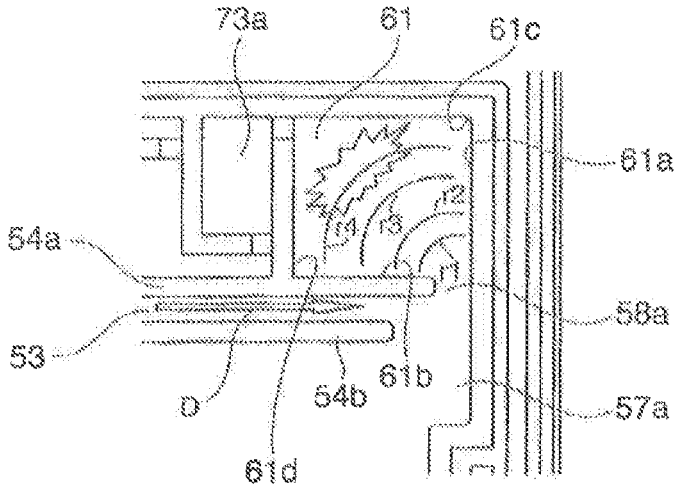
FIG. 17 is a schematic diagram illustrating an extinction of air bubbles when waste ink is delivered into an ink storage unit of the ink cartridge of FIG. 16.

FIG. 17 schematically illustrates the extinction of bubbles when the ink discharge needle is inserted into the ink inlet/outlet 55 and waste ink is fed through the ink path 53 and into the ink storage unit 45.

The waste ink that is fed into the ink path 53 can contain air bubbles in addition to the waste ink. As a result, some of the bubbles that flow with the waste ink, through the ink path 53, move from the communication path 58*a* and into the air chamber 61. Because in the illustrated embodiment the area of the air chamber 61 is greater than the other parts, the air bubbles that enter the air chamber 61 can combine to form a large bubble r1, which continues to grow into bubbles r2 and r3, and finally grows into a large bubble r4, at which point the surface tension of the outside surface of the bubble becomes low and the bubble pops. As a result, the bubble of waste ink and air does not enter the buffer chamber 73*a* that communicates with the air escape hole 89, and only air enters the buffer chamber 73*a*.

Because the air chamber 61 of the illustrated embodiment must be large enough for the bubble r1 to grow to bubbles r2 and r3 and finally to the size of a bubble r4 that pops naturally, a fan-shaped space that is centered on the communication path 58*a* and includes the corner 61*c* of one wall 61*a* of the air chamber 61 and the corner 61*d* of the other wall 61*b* is required. In this embodiment of the invention, however, the air chamber 61 is not fan-shaped, and instead has a rectangular shape that is easy to manufacture.

Experiments have demonstrated that all bubbles pop when the cross sectional area between the corners 61*c* and 61*d* related to the size of the outside surface of the growing bubble is greater than or equal to 63 square millimeters, and that if smaller than this area, the bubble does not pop and grows until it fills the air chamber 61. In this embodiment of the invention, therefore, the cross sectional area between corner 61*c* and corner 61*d* is 70 square millimeters or greater so that the bubbles pop reliably. If the other buffer chambers 72*a* to 72*h* and 73*a* are formed smaller than the air chamber 61, more buffer chambers can be formed and the flow of waste ink to the outside air channel 87 can be easily prevented. The outside air channel 87 is preferably disposed around a periphery of the ink cartridge 17, 17B, 17C surrounding the air chamber 61, ink storage unit 45, and buffer chambers because a long outside air channel 87 can thus be formed and fluid leakage through the outside air channel to the outside of the fluid storage container can be reduced.

A valve 77 may be associated with the air escape hole 89 in the most recent embodiment in manner similar as those described with respect to earlier embodiments, for example by being disposed at a position in the air escape hole 89. The valve may be appropriately opened when installing the ink cartridge 17 in the cartridge loading unit 15 and when removing waste ink so that waste ink can be easily introduced to the ink storage unit 45 and waste ink can be easily removed from the ink storage unit 45.

In addition to ink cartridges such as those used in inkjet printers as described above, the fluid storage container according to the present invention can be applied in fluid supply devices that use fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a fluid storage container that is used in a reagent discharge device used as a precision pipette. Other devices that also incorporate fluid discharge can be adapted for use with the embodiments disclosed herein without departing from the spirit of the invention.

The concept of a fluid as used herein also includes gels, high viscosity materials, and mixtures of a solid in a solvent, and the concept of an ink includes aqueous inks and oil-based inks.

Although the present invention has been described in connection with the preferred embodiments thereof with reference to the accompanying drawings, various changes and modifications will be apparent to those skilled in the art. Such changes and modifications are to be understood as included within the scope of the present invention as defined by the appended claims, unless they depart therefrom.

What is claimed is:

1. A fluid storage container detachably connected to an apparatus comprising:

a body;

a first opening and a second opening disposed on the body;

a fluid storage unit provided in the body and configured to store fluid fed through the first opening;

an air path having a first end that communicates with the fluid storage unit and a second end that communicates with an outside environment;

a fluid path communicating with the first opening and the fluid storage unit; and a recess formed in a portion of the fluid storage unit, wherein the fluid path is defined by a first wall and a second wall, the first wall being located closer to the first end of the air path than the second wall is, and the second wall being shorter than the first wall, the terminal end of the first wall being positioned within the recess.

2. The fluid storage container described in claim 1, wherein the terminal end of the second wall is positioned outside of the recess.

3. The fluid storage container described in claim 1, wherein the recess is configured to be disposed at a bottom of the fluid storage container when removing fluid stored in the fluid storage container.

4. The fluid storage container described in claim 1, wherein a terminal end of the first wall is located closer to a portion of the air path that is adjacent to and extends substantially perpendicular to the first and second walls than a terminal end of the second wall does.

5. The fluid storage container described in claim 1, wherein the fluid storage unit has a first chamber and a second chamber formed therein, with the first chamber being configured to be an air chamber, and wherein the first chamber is configured to be positioned above the first wall when the fluid storage container is connected to the apparatus.

6. The fluid storage container described in claim 5, further comprising:

an opening disposed between the fluid path and the first chamber, the opening being configured to be positioned above the first wall when the fluid storage container is connected to the apparatus.

7. The fluid storage container described in claim 6, wherein the opening forms a communication path disposed between the terminal end of the first wall and a portion of the fluid storage unit located opposite of the first wall.

* * * * *